United States Patent [19]

Sangster et al.

[11] 4,330,050

[45] May 18, 1982

[54] PORTABLE ARTICLE CARRYING CASE

[76] Inventors: Marshall A. Sangster, 35 Glenside Trail, Sparta, N.J. 07871; Barrett E. Sangster, Lake Dr., R.D. #2, Stanhope, N.J. 07874

[21] Appl. No.: 152,674

[22] Filed: May 23, 1980

[51] Int. Cl.[3] ..... A45C 3/00

[52] U.S. Cl. ..... 190/51; 190/55 R; 206/425; 220/318; 312/184; 292/259 R; 292/DIG. 30

[58] Field of Search ..... 190/51, 57, 52, 58 R, 190/55 R; 206/214, 328, 449, 425; 312/184, DIG. 33, 244; 220/314, 318; 292/259 R, DIG. 30, 247

[56] References Cited

U.S. PATENT DOCUMENTS

| | | | |
|---|---|---|---|
| 690,441 | 1/1902 | King | 220/318 |
| 1,687,859 | 10/1928 | Fontaine | 312/184 |
| 2,652,909 | 9/1953 | Knell | 190/58 R |
| 2,678,651 | 5/1954 | De Whalley | 312/184 X |
| 2,925,904 | 2/1960 | Eichholz | 312/244 |
| 3,259,214 | 7/1966 | Platt | 190/55 R X |
| 3,305,052 | 2/1967 | Kish | 190/58 R X |
| 3,539,235 | 11/1970 | Cuenca | 312/184 |
| 3,724,920 | 4/1973 | Beck | 206/425 X |

FOREIGN PATENT DOCUMENTS

| | | | |
|---|---|---|---|
| 962354 | 12/1949 | France | 292/247 |

*Primary Examiner*—Donald F. Norton

[57] ABSTRACT

A portable article carrying case has a container with a pair of opposing upright sidewalls and a pair of opposing upright end panels extending from the bottom of the container. A pair of spaced rods are each mounted within the container alongside the upper edge of a different one of the end panels. A plurality of apertured dividers extend between the rods. The rods slidably retain the dividers by means of their apertures. The case also has a flexible sheet material foldably extending downwardly from at least two adjacent dividers to form a pocket for retaining articles.

13 Claims, 4 Drawing Figures

FIG. 4
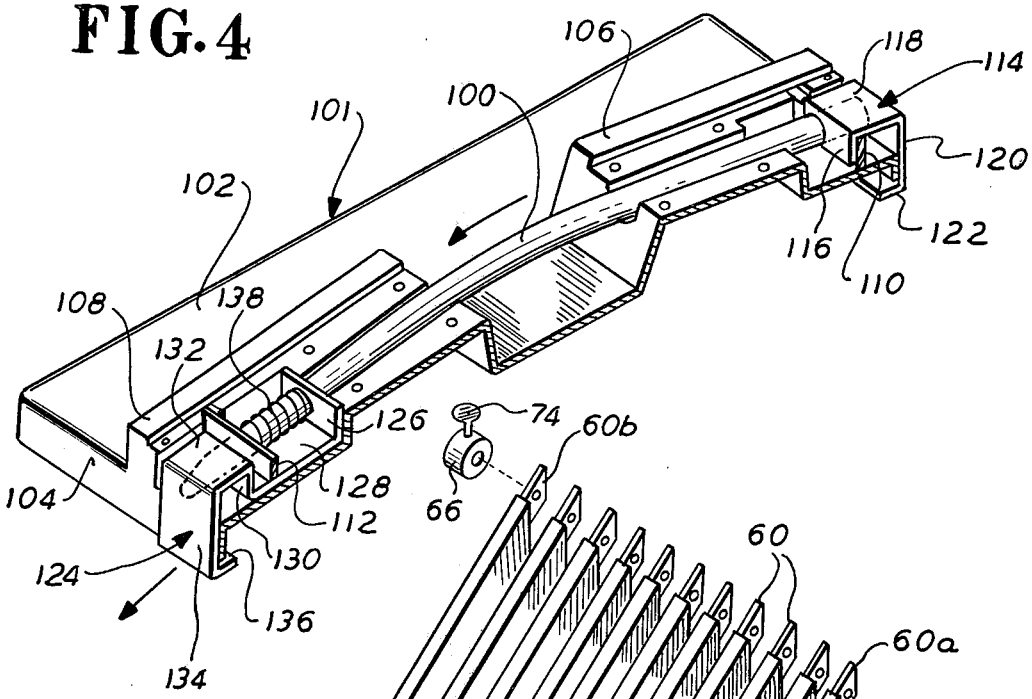
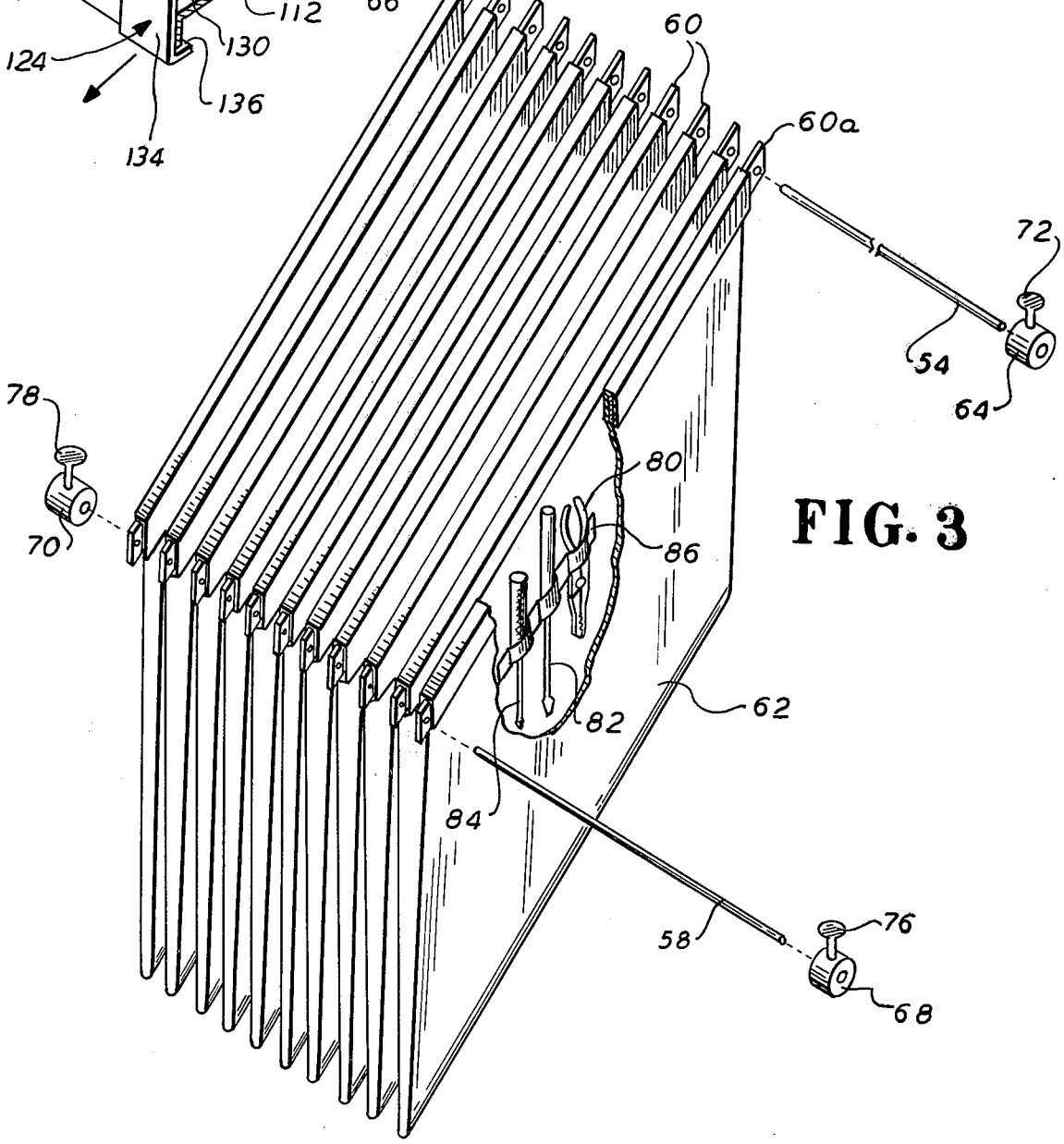
FIG. 3

PORTABLE ARTICLE CARRYING CASE

BACKGROUND OF THE INVENTION

This invention is concerned with an article-carrying case particularly an electronic field engineer's article carrying case.

In the past the art has described a number of cases for carrying articles such as typewriters, medicines, instruments, cosmetics, sporting equipment, tools and the like. The present invention is concerned with a portable article carrying case particularly for carrying electronic engineer's equipment such as circuit boards, small tools and sheet material. The carrying case of this invention is designed to carry equipment of varying sizes and thicknesses such as loaded circuit boards separately within expandable pockets located in the case. The cover of the carrying case of this invention contains a novel arrangement which lifts the total weight of the loaded case from rigid end panels on the container thereby avoiding a buckling action which would occur if the lifting location was centered on the cover.

SUMMARY OF THE INVENTION

In accordance with the illustrative embodiments demonstrating features and advantages of the present invention there is provided a portable article carrying case including a container. The container has a bottom, a pair of opposite upright sidewalls and a pair of opposing upright end panels. The portable case also includes a pair of spaced rods, each mounted within the container alongside the upper edge of a different end of the end panels. Also included is a plurality of apertured dividers. These dividers extend between the rods. Each divider is slidably retained by the rods extending through the divider apertures. The portable article carrying case also includes a flexible sheet material foldably extending downwardly from at least two adjacent dividers to form a pocket for retaining articles.

In a preferred embodiment of the present invention the portable article carrying case employs a cover having a handle that extends across the cover and downwardly over the edges of the cover. Preferably, the handle terminates in hooks which can engage latches mounted on the end panels of the carrying case. This latter arrangement transfers the load of the handle onto the side panels. Since the transferred forces are applied vertically the tendency for the cover of the case to buckle is avoided. In one embodiment the above latches include an articulated jaw for drawing the hooks of the handle downwardly to secure the cover.

Preferably, the end panels of the container have a rim section into which is formed an inner peripheral channel. The bottom and side walls of the container can be inserted and secured in this channel. Furthermore, the upper horizontal section of this peripheral channel can be used as the mounting site for the above mentioned pair of spaced rods. Also, in a preferred embodiment each of the rods has an adjustable collar for limiting the movement of the dividers. This feature is useful where the articles being carried are few or are relatively thin and their freedom of motion ought to be restricted to prevent uncontrolled sliding.

In an alternate embodiment of the present invention the cover has a handle which is slidably mounted on one of its ends in an apertured member. Depending from this end of the handle is a slidable latch member which is configured to grasp the upper rim of the container.

An advantage of the foregoing arrangement is that the upward force applied to the handle during lifting causes the latch to be drawn more tightly against the rim of the container, thereby securely affixing the cover to the container.

The foregoing carrying case is particularly useful in carrying articles such as printed circuit boards and the tools associated with repairing and installing such boards. In one embodiment the sheet material forming pockets is fabricated from conductive material to prevent accumulation of electrical charges on high impedance components on the printed circuit board. Also, in one embodiment the pocket formed by the sheet material have flexible loops into which various tools can be inserted.

BRIEF DESCRIPTION OF THE DRAWINGS

FIG. 3 is an exploded view of portions of the contents of the case of FIG. 1; and FIG. 4 is a perspective view of a sectioned cover which is an alternate to that illustrated in FIG. 1.

DETAILED DESCRIPTION OF THE PREFERRED EMBODIMENTS

Figure 1:
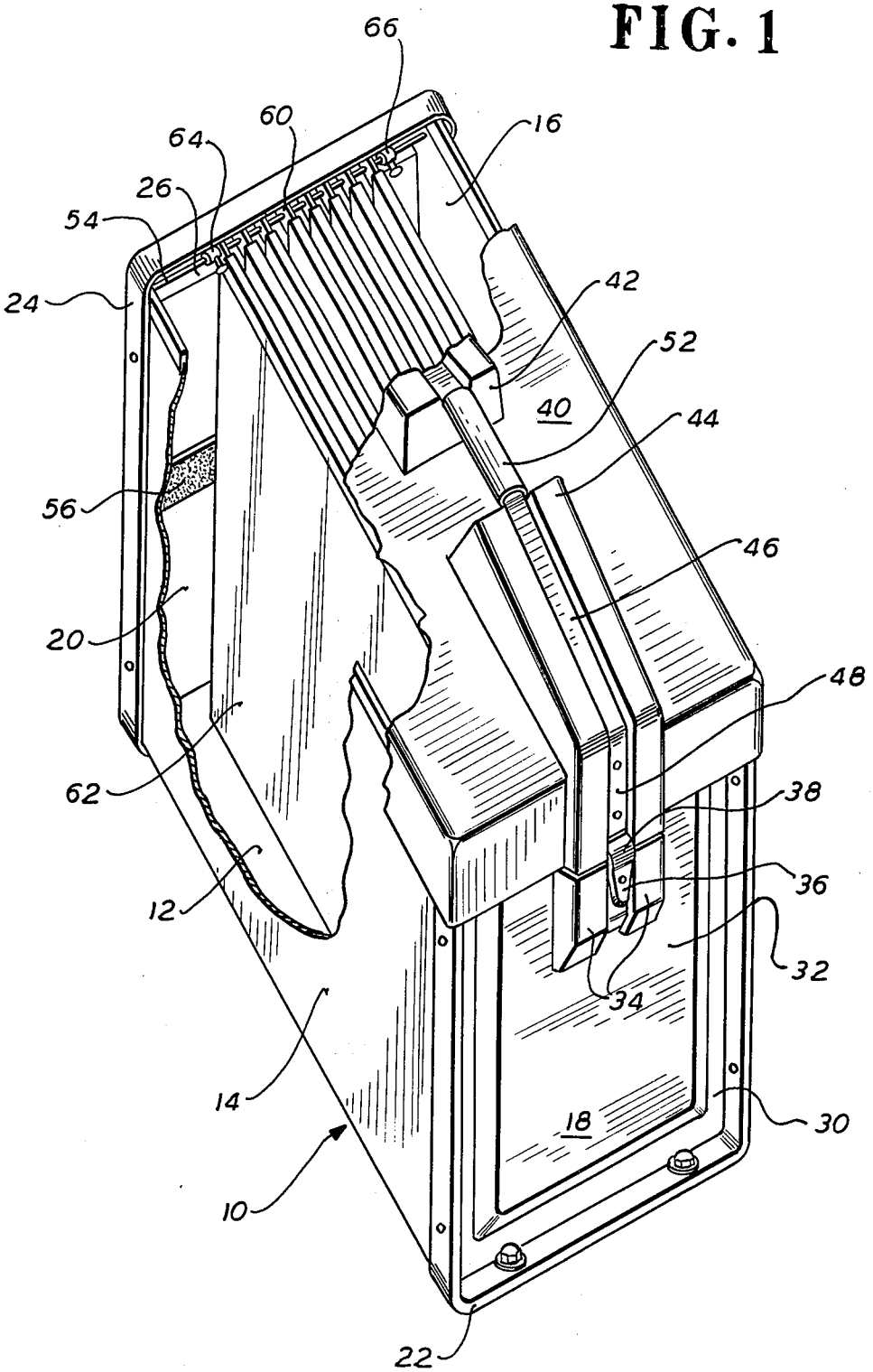
FIG. 1 is a perspective view of the portable article carrying case of the present invention which has portions broken away for the sake of clarity.
Figure 2:
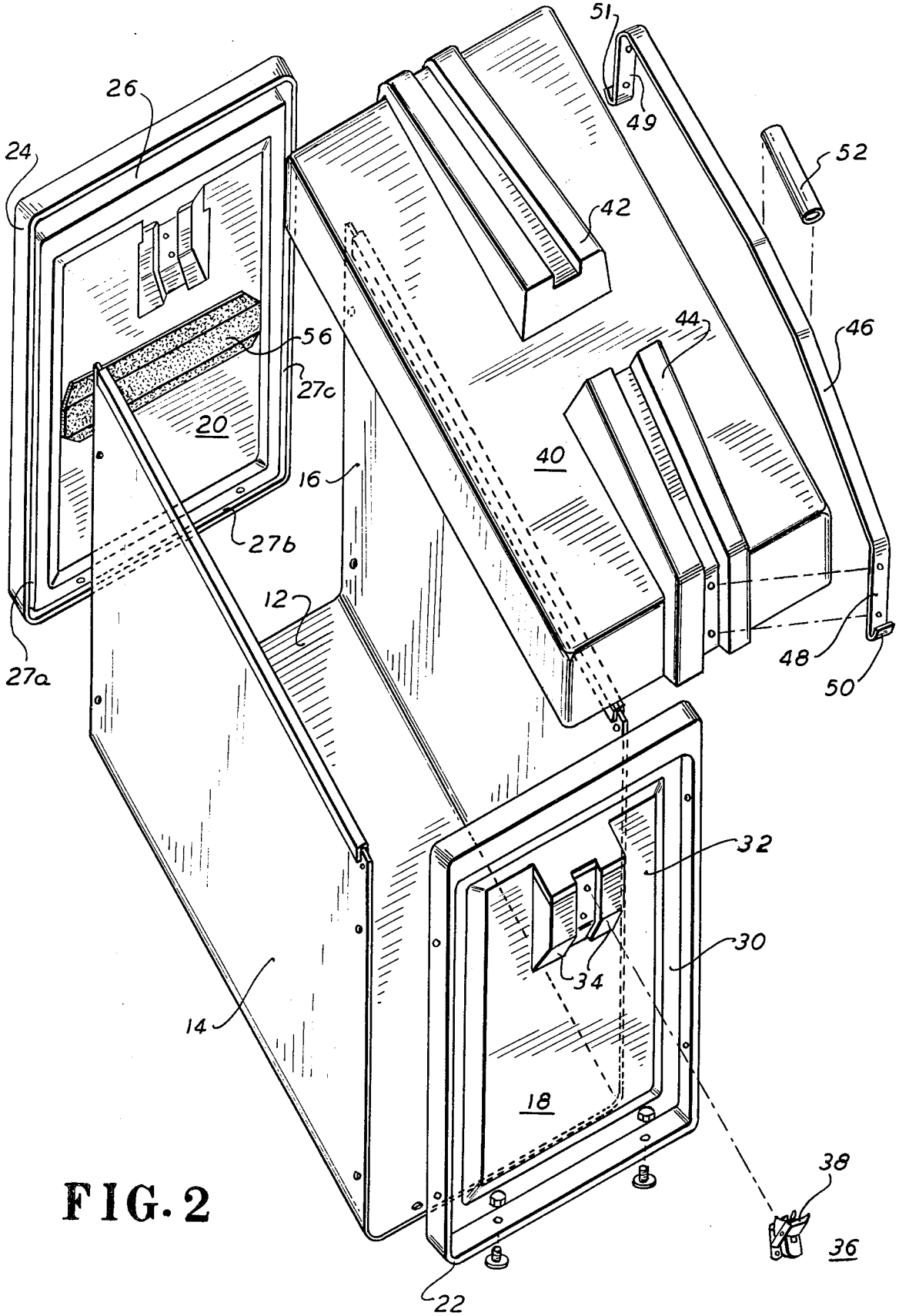
FIG. 2 is an exploded view of the case of FIG. 1.

Referring to FIGS. 1 and 2, a portable article carrying case according to this invention is shown. A container 10 is shown herein as a unitary plastic extrusion having a bottom 12 and a pair of upright sidewalls 14 and 16. Container 10 also has a pair of end panels 18 and 20. In this embodiment end panels 18 and 20 are formed of rigid plastic and have a rim section shown herein as rim 22 and 24, respectively. The foregoing rim sections are shaped to provide an inner peripheral channel. The channels extend around the entire perimeter of panel 18 and panel 20. The upper portion of the channel of end panel 20 is shown as channel 26 and the other portions are identified as subchannels 27*a*, 27*b* and 27*c*. Each of the panels 18 and 20 has a recessed annular plateau and a raised central plateau. These plateaus are illustrated in FIG. 1 for panel 18 as recessed plateau 30 and raised plateau 32. Panels 18 and 20 each have a pair of spaced bosses, such as bosses 34, between which a latch, such as latch 36 is mounted. As explained subsequently latch 36 employs an articulated jaw 38 which can be manually actuated to be drawn downwardly. This latch may be one of many conventional devices commonly employed in suitcases, brief cases and other article carrying cases.

While a specific container is illustrated herein, it is to be appreciated that the container may be formed in various other manners. Instead of discrete end panels, in some embodiments the entire container sections may be molded integrally. Also, in some embodiments different latches may be employed and may be mounted in various locations.

Cover 40 is shown herein as an open, five sided rectangular tray made of molded plastic although other shapes may be employed instead. Extending across and downwardly on cover 40 are a pair of grooved bosses 42 and 44. Mounted within the grooves of bosses 42 and 44 is handle 46 which, in this embodiment, is a strip of metal such as aluminum. Handle 46 has a longitudinal portion extending atop cover 40 and downwardly extending portions 48 and 49 which terminate in hooks 50 and 51, respectively. Handle 46 is centrally fitted with a tubular gripping member 52 formed of a soft plastic designed to prevent the sharp edges of handle 46 from digging into the palm of the hand.

Mounted within container 10 are a pair of spaced rods. One such rod, rod 54, is shown mounted within the upper run of peripheral channel 26. A matching rod (illustrated subsequently) is mounted in the corresponding upper run of the peripheral channel of end panel 18. Rod 54 is mounted across opposite apertures (not shown) in side walls 14 and 16. It is to be appreciated, however, that rod 54 can be mounted in alternative manners. For example, rod 54 can have downwardly bent ends which engage apertures in the peripheral channel 26. Mounted on the inside surface of panels 18 and 20 is a resilient, sponge-like member, such as pad 56. As will be clear from subsequent description, pad 56 presses against the edge of pockets suspended within container 10 to restrict their motion.

Some of the contents of container 10 as shown in FIG. 1 are more clearly illustrated in FIG. 3. Previously illustrated rod 54 is shown herein together with the opposite rod 58. Also shown herein are a plurality of apertured dividers 60. In this embodiment 11 such dividers are shown, although other numbers of dividers may be employed instead. The dividers in this embodiment are fabricated preferably of a strip of metal, such as aluminum, each having a transverse aperture in each end. These apertures are sized and aligned to receive rods 54 and 58. Flexible sheet material is shown herein as a web of soft plastic material 62 pleated into pockets. Material 62 is secured to terminal divider 60*a*, is draped across each of the dividers 60 and terminates on terminal divider 60*b*. Preferably material 62 is a soft conductive material which prevents the accumulation of stray charges on the components carried within the folds of material 62.

The range of movement of dividers 60 on rods 54 and 58 is limited by two pairs of adjustable collars, collars 64, 66, 68 and 70. These collars are mounted as spaced pairs on each of the rods 54 and 58 to define an interspace wherein the dividers 60 are free to move. This feature is useful where the articles being carried within the folds of material 62 are thin and excessive motion ought to be avoided. Each of the above collars have a manually rotatable set screw shown herein as wing bolts 72, 74, 76 and 78 which thread through the sides of collars 64, 66, 68 and 70, respectively.

In this embodiment tools 80, 82 and 84 are conveniently mounted within one fold of material 62 by means of a band 86 which is stitched at four spaced intervals to form three loops into which tools 80–84 can be inserted.

To facilitate an understanding of the principles associated with the foregoing apparatus, its operation will be briefly described. The cover 40 is initially removed exposing the pockets in material 62. After articles are placed into the folds of material 62 the user may adjust the spacing of collars 64–70 to provide the appropriate room for the articles being carried. Sponge-like material 56 bears against the material 62 to prevent excessive swinging of articles carried within material 62. Once container 10 is thus filled, cover 40 is fitted over the top of container 10 bringing hooks 50 and 51 within the grasp of the latches on end panels 18 and 20. The jaw 38 of latch 36 is manipulated to engage hook 50 and is actuated to draw jaw 38 and hook 50 downwardly, thereby securing one end of cover 40. A similar operation for the other end of cover 40 secures both ends so that the cover does not shift. Thereafter the case may be raised by grasping grip 52. It will be appreciated that such lifting transfers the load along downward extensions 48 and 49 of handle 46. Accordingly, the load is not carried by cover 40, thereby avoiding buckling thereof. Instead the forces are transferred to the end panels through latches such as latch 36 and its corresponding boss 34.

Referring to FIG. 4, a cover 101 is illustrated which is an alternate to that previously described. This cover is sectioned but it is to be understood that it is symmetrical with respect to a vertical plane passing through the center of handle 100. The above cover comprises a generally planar section 102 having dependent skirts such as edge 104. Formed atop cover 101 is a first and second housing shown herein as grooved boss 106 and 108, respectively. Mounted within opposing slots in boss 106 in boss 108 are stationary apertured members 110 and 112, respectively.

Mounted within the longitudinal grooves in bosses 106 and 108 is handle 100. One of its ends is affixed to a fixed latch member 114. Member 114 is in the shape of a metal strip bent at right angles at three corners. Accordingly, member 114 comprises a first, apertured inner plate 116 which receives handle 100 and which has extending outwardly from its upper edge a first upper plate 118. Upper plate 118 has depending from its outer edge a first side plate 120 which has inwardly extending from it a shoulder 122. Latch member 114 is secured to fixed member 110 by appropriate means such as rivets, pins or other devices.

Mounted on handle 100 at the end opposite fixed latch 114 is moveable latch member 124. Moveable latch member 124 is slidably mounted within boss 108. Latch member 124 is formed of a strip of metal which has right angle bends at five places. Consequently, member 124 is formed into a vertical apertured abutment plate 126, a horizontal bottom plate 128, a second apertured inner plate 130, a second upper plate 132, a second side plate 134, and a second shoulder 136. Handle 100 is routed through apertures in plates 126 and 130 and is secured to member 124 by appropriate means such as rivets or pins. Moveable latch 124 is biased inwardly by a spring means, shown herein as a helical compression spring 138 encircling handle 100 and mounted between abutment plate 126 and stationary member 112. Accordingly, spring 138 tends to drive shoulder 136 inwardly.

To facilitate an understanding of the principles associated with the apparatus of FIG. 4, its operation will be briefly described. The cover 101 is tilted upwardly so that the shoulder 122 of the fixed latch member 114 can engage the rim of an end panel such as the upper portion of rim 22 (FIG. 2). The handle 100 is then pushed toward moveable latch member 124 whereupon it moves outwardly. The cover is then placed over the other side of the container and the handle is released. The tension in spring 138 acts to move shoulder 136 inwardly thereby securing it to the rim of the end panel associated therewith. Unlatching occurs by reversing the above steps.

It is to be appreciated that modifications and alterations may be implemented with respect to the apparatus described. For example, the shapes of various components may alter depending upon the size of the article being carried, its weight etc. In addition, numerous materials may be substituted for those described depending upon the desired strength, weight etc. In addition, numerous covers and handles may be designed with various latches. Obviously many other modifications and variations of the present invention are possible in light of the above teachings. It is therefore to be understood that within the scope of the appended claims the invention may be practiced otherwise than as specifically described.

What is claimed is:

1. A portable article carrying case comprising:

(a) a container having a bottom, a pair of opposing upright side walls and a pair of opposing upright end panels;

(b) a pair of spaced rods each mounted within said container alongside the upper edge of a different one of said pair of end panels;

(c) a plurality of apertured dividers, extending between said rods, each divider being slidably retained by said rods extending through said divider apertures;

(d) a flexible sheet material foldably extending downwardly from at least two adjacent dividers to form a pocket for retaining articles;

(e) a cover sized to superpose upon said container; and (f) a handle extending across the top of said cover having latch members at the ends thereof respectively engaging projections on the end panels so that the total weight of the case and its contents is transferred directly to said handle from said end panels.

2. A portable article carrying case comprising:

(a) a container having a bottom, a pair of opposing upright side walls and a pair of opposing upright end panels;

(b) a pair of spaced rods each mounted within said container alongside the upper edge of a different one of said pair of end panels;

(c) a plurality of apertured dividers, extending between said rods, each divider being slidably retained by said rods extending through said divider apertures;

(d) a flexible sheet material foldably extending downwardly from at least two adjacent dividers to form a pocket for retaining articles, and (e) an adjustable collar slidably mounted on one of said pair of spaced rods for restricting the freedom of motion of said dividers.

3. The case of claim 2 wherein said collar comprises:

a manually rotatable set screw for securing said collar to said rod.

4. The case of claim 2 further comprising:

two pairs of adjustable collars, each pair being mounted on a different one of said rods to restrict the freedom of motion of said dividers.

5. A container for a portable article-carrying case comprising:

(a) a bottom;

(b) a pair of side walls extending upwardly from said bottom;

(c) a pair of end panels comprising a rim section having an inner peripheral channel and a pair of apertures located in the upper portion of said section and an end wall enclosed by said rim section, the edges of said bottom and said side walls being retained in said channels to form an open container;

(d) a pair rods, each extending along the upper portion of each of said rim sections along said inner channel, the ends of said rods being inserted in said apertures;

(e) a plurality of apertured dividers retained by said rods extending through said divider aperturers; and (f) a flexible sheet material foldably extending downwardly from at least two adjacent dividers to form a pocket for retaining articles.

6. The container of claim 5 wherein said sheet material is comprised of a soft plastic material.

7. The container of claim 5 wherein a single sheet material foldably extends downward between more than two of said dividers.

8. The container of claim 5 wherein said end wall is recessed inwardly from said rim section.

9. A portable article-carrying case comprising:

(a) a bottom;

(b) a pair of side walls extending upwardly from said bottom;

(c) a pair of end panels comprising a rim section having an inner peripheral channel and a pair of apertures located in the upper portion of said section, and an end wall enclosed by said rim section, the edges of said bottom and said side walls being retained in said channels to form an open container;

(d) a pair of rods, each extending along the upper portion of each of said rim sections along said inner channel, the ends of said rods being inserted in said apertures;

(e) a plurality of apertured dividers extending between said rods, each divider being slidably retained by said rods extending through said divider apertures;

(f) a flexible sheet material foldably extending downwardly from at least two adjacent dividers to form a pocket for retaining articles;

(g) a cover secured over said container; and (h) a handle associated with said cover.

10. The case of claim 9 wherein said sheet material is comprised of a soft plastic material.

11. The case of claim 9 wherein a single sheet material foldably extends downward between more than two of said dividers.

12. The case of claim 9 wherein said end wall is recessed inwardly from said rim section.

13. A portable article carrying case comprising:

(a) a bottom;

(b) a pair of side walls extending upwardly from said bottom;

(c) a pair of end panels comprising a rim section having an inner peripheral channel and a pair of apertures located in the upper portion of said section and an end wall enclosed by said rim section, the edges of said bottom and said side walls being retained in said channel to form an open container;

(d) a pair of rods, each extending along the upper portion of each of said rim sections along said inner channel, the ends of said rods being inserted in said apertures;

(e) a plurality of apertured dividers, extending between said rods, each divider being slidably retained by said rods extending through said divider apertures;

(f) a flexible sheet material foldably extending downwardly from at least two adjacent dividers to form a pocket for retaining articles;

(g) a cover secured over said container;

(h) a first and second boss mounted on said cover, each boss containing a handle channel;

(i) a handle mounted atop and extending across said cover, said handle having a longitudinal portion, each of its ends terminating in a downwardly extending hooked portion;

(j) a pair of latches each externally mounted on a different one of said end panels, each latch including an articulated jaw which is manually drivable in a downward direction, said jaw being arranged to detachably engage said hooked portion of said handle;

(k) two pairs of adjustable collars, each pair being mounted on a different one of said rods to bound and restrict the freedom of motion of said dividers; and (l) a manually rotatable set screw for securing said collar to said rod.

* * * * *